US007059427B2

(12) United States Patent
Power et al.

(10) Patent No.: US 7,059,427 B2
(45) Date of Patent: Jun. 13, 2006

(54) AUTOMATIC DRILLING SYSTEM

(75) Inventors: David J. Power, Stafford, TX (US); Gerhard P. Glaser, Houston, TX (US)

(73) Assignee: Noble Drilling Services Inc., Sugar Land, TX (US)

( * ) Notice: Subject to any disclaimer, the term of this patent is extended or adjusted under 35 U.S.C. 154(b) by 146 days.

(21) Appl. No.: 10/667,296

(22) Filed: Sep. 17, 2003

(65) Prior Publication Data

US 2004/0195004 A1 Oct. 7, 2004

Related U.S. Application Data

(60) Provisional application No. 60/459,503, filed on Apr. 1, 2003.

(51) Int. Cl.
*E21B 3/06* (2006.01)
*E21B 44/00* (2006.01)

(52) U.S. Cl. ..... 175/27; 175/48

(58) Field of Classification Search ..... 175/24, 175/26, 27, 45, 48
See application file for complete search history.

(56) References Cited

U.S. PATENT DOCUMENTS

| | | | | |
|---|---|---|---|---|
| 2,003,078 A | | 5/1935 | Hild | 255/19 |
| 2,005,889 A | | 6/1935 | Dillon | 255/19 |
| 2,136,256 A | | 11/1938 | Hild | 255/19 |
| 2,688,871 A | | 9/1954 | Lubinski | 73/151.5 |
| 3,031,169 A | | 4/1962 | Robinson | 254/173 |
| 3,039,543 A | | 6/1962 | Loocke | 175/26 |
| 3,155,172 A | | 11/1964 | Kazmin | 173/6 |
| 3,324,717 A | | 6/1967 | Brooks | 73/152 |
| 3,550,697 A | * | 12/1970 | Hobhouse | 175/26 |
| 4,419,886 A | * | 12/1983 | Peterson | 73/152.44 |
| 4,491,186 A | | 1/1985 | Alder | 175/26 |
| 4,535,972 A | | 8/1985 | Millheim | 254/277 |
| 4,662,608 A | | 5/1987 | Ball | 254/273 |
| 4,825,962 A | | 5/1989 | Girault | 175/26 |
| 4,875,530 A | * | 10/1989 | Frink et al. | 175/27 |
| 4,886,129 A | | 12/1989 | Bourdon | 175/40 |
| 4,976,143 A | * | 12/1990 | Casso | 73/152.45 |
| 5,167,400 A | * | 12/1992 | Gazel-Anthoine | 254/275 |
| 5,274,552 A | * | 12/1993 | Milburn | 702/9 |
| 5,458,207 A | * | 10/1995 | Mattero | 175/27 |
| 5,474,142 A | * | 12/1995 | Bowden | 175/27 |
| 5,709,285 A | * | 1/1998 | Sokalski et al. | 188/106 F |

(Continued)

OTHER PUBLICATIONS

Boyadjieff, George; Murray, Dave; ORR, Alan; Porsche, Mike; "Design Considerations and Field Performance of an Advanced Automatic Driller" SPE/IADC Drilling Conference; Feb. 19-21, 2003; pp. 1-11.

(Continued)

*Primary Examiner*—William Neuder
*Assistant Examiner*—Nicole Coy
(74) *Attorney, Agent, or Firm*—Jonathan E. Jobe; Richard A. Fagin

(57) ABSTRACT

An automatic drilling system is disclosed which includes an electric servo motor operatively coupled to a winch brake control, a servo controller operatively coupled to the servo motor, and a drum position encoder rotationally coupled to a winch drum. The controller is adapted to operate the servo motor in response to measurements of position made by the encoder so that a selected rate of rotation of the drum is maintained.

22 Claims, 4 Drawing Sheets

U.S. PATENT DOCUMENTS

| | | | | |
|---|---|---|---|---|
| 5,713,422 | A * | 2/1998 | Dhindsa | 175/27 |
| 6,029,951 | A * | 2/2000 | Guggari | 254/269 |
| 6,186,248 | B1 * | 2/2001 | Silay et al. | 175/27 |
| 6,192,998 | B1 | 2/2001 | Pinckard | 175/27 |
| 6,246,343 | B1 * | 6/2001 | Deng et al. | 341/11 |
| 6,405,808 | B1 * | 6/2002 | Edwards et al. | 175/45 |
| 2003/0234119 | A1 * | 12/2003 | Ray | 175/27 |
| 2004/0226748 | A1 * | 11/2004 | Prior et al. | 175/27 |

OTHER PUBLICATIONS

Young, Jr., F.S.; "Computerized Drilling Control" J. of Petroleum Technology; Apr. 1969; pp. 483-496.

Brett, J. F.; Warren, T.M. and Wait, D.E.; "Field Experiences with Computer-Controlled Drilling" Society of Petroleum Engineers; Mar. 8-9, 1990; pp. 197-212.

Friman, Thorbjorn; "Lidan Brake Servo Systems" Function and principal introduction booklet; May 15, 2002; pp. 1-11.

* cited by examiner

AUTOMATIC DRILLING SYSTEM

CROSS REFERENCE TO RELATED APPLICATION

This application claims the benefit of U.S. Provisional Application No. 60/459,503, filed Apr. 1, 2003, and titled Automatic Drilling System.

BACKGROUND OF INVENTION

1. Field of the Invention

The invention relates generally to drilling wellbores through subsurface earth formations. More particularly, the invention relates to a system for automatically controlling the rate of release of a drill string to maintain a selected control parameter during drilling.

2. Background Art

Drilling wellbores through the earth includes "rotary" drilling, in which a drilling rig or similar lifting device suspends a drill string which turns a drill bit located at the bottom end of the drill string. Equipment on the rig, such as a rotary table/kelly or a top drive turns the drill string. Some drill strings may include an hydraulically operated motor to rotate the bit in addition to or in substitution of rotating the drill string from the surface. The rig includes lifting equipment that suspends the drill string so as to place a selected axial force (weight on bit—"WOB") on the drill bit as the bit is rotated. The combined axial force and bit rotation causes the bit to gouge, scrape and/or crush the rocks, thereby drilling a wellbore through the rocks. Typically a drilling rig includes liquid pumps for forcing a fluid called "drilling mud" through the interior of the drill string. The drilling mud is ultimately discharged through nozzles or water courses in the bit. The mud lifts drill cuttings from the wellbore and carries them to the earth's surface for disposition. Other types of drilling rigs may use compressed air as the fluid for lifting cuttings.

Drilling boreholes in subsurface formations for oil and gas wells is very expensive and time consuming. Formations containing oil and gas are typically located thousands of feet below the earth surface. Therefore, thousands of feet of rock and other geological formations must be drilled through in order to establish producible wells. While many operations are required to drill and complete a well, perhaps the most important is the actual drilling of the borehole. The cost associated with drilling a well is primarily time dependent. Accordingly, the faster the desired penetration depth is achieved, the lower the cost for drilling the well. However, cost and time associated with well construction can increase substantially if wellbore instability problems or obstacles are encountered during drilling. Therefore, successful drilling requires achieving a penetration depth as fast as possible but within the safety bounds defined for the particular drilling operation.

Achieving a penetration depth as fast as possible during drilling requires drilling at an optimum rate of penetration (ROP). The rate of penetration achieved during drilling depends on many factors, however, the primary factor is weight on bit. As disclosed in U.S. Pat. No. 4,535,972 to Millheim et al., for example, rate of penetration generally increases with increasing weight on bit until a certain weight on bit (WOB) is reached. ROP decreases as additional weight on bit is applied above the certain weight. Thus, there is generally a particular weight on bit that will achieve a maximum rate of penetration for each set of drilling conditions. However, the rate of penetration of a drill bit also depends on many factors in addition to the weight on bit. For example, the rate of penetration depends upon characteristics of the formation being drilled, the speed of rotation of the drill bit (RPM), and the rate of flow of the drilling fluid, among other factors. Because of the complex nature of drilling, a weight on bit that is optimum for one set of conditions may not be optimum for another set of conditions.

One method known in the art to determine an optimum rate of penetration for a particular set of drilling conditions is known as a "drill off test," which is disclosed, for example, in U.S. Pat. No. 4,886,129 to Bourdon. During a drill off test, a drill string supported by a drilling rig is lowered into the wellbore. When the bit contacts the bottom of the borehole, drill string weight is transferred from the rig to the bit (by releasing the drill string into the wellbore) until an amount of weight greater than the expected optimum weight on bit is applied to the bit. Then, while holding the drill string against vertical motion at the surface, the drill bit is rotated at the desired rotation rate with the fluid pumps at the desired pressure. As the bit is rotated, it cuts through the earth formations. Because the drill string is held against vertical motion at the surface, weight is increasingly transferred from the bit to the rig as the bit cuts through the earth formation. As disclosed in U.S. Pat. No. 2,688,871 to Lubinsky, by applying Hooke's law, an instantaneous rate of penetration may be calculated from the instantaneous rate of change of weight on bit. By comparing bit rate of penetration with respect to weight on bit during the drill off test, an optimum weight on bit can be determined. In typical drilling operations, once an optimum weight on bit is determined, the "driller" (the drilling rig operator) attempts to maintain the weight on bit at that optimum value during drilling.

One of the more difficult tasks performed by the driller is to maintain the WOB as nearly as possible at the most efficient value. During typical drilling operations, maintaining the WOB is performed by manually operating a friction brake to control the speed at which a drawworks winch drum releases a wire rope or cable. The wire rope, through a system of sheaves, suspends the drill string within the rig structure. There are a number of electrical (eddy current) braking devices, hydraulic braking devices and electro-hydraulic devices well known in the art that perform braking control or its functional equivalent to control the rate of drum rotation (and consequent cable release) Manual control of WOB is difficult. The driller must visually observe a weight indicator or other display, such as a mud pressure gauge, and control the drum speed, typically by operating the brake, so as to maintain the WOB or mud pressure at or close to a selected value.

Because of the obvious difficulty of manual control of WOB or related parameter, there have been many devices designed to automate at least this aspect of drilling rig operation. Typical examples of electromechanical automatic drilling devices are shown in U.S. Pat. No. 3,031,169 to Robinson et al.; U.S. Pat. No. 4,825,962 to Girault; U.S. Pat. No. 4,491,186 to Alder; U.S. Pat. No. 4,875,530 to Frink et al.; U.S. Pat. No. 4,662,608 to Ball; and U.S. Pat. No. 5,474,142 to Bowden. Another example of a brake control device is shown in a sales brochure entitled, *Lidan Brake Servo Systems*, Lidan Engineering AB, Jacobstorp, S-531 98, Lidköping, Sweden (2003).

The foregoing devices, as well as others known in the art, either control brake operation or control winch rotation, or both, using mechanical or electromechanical sensing devices and electrical and/or mechanical coupling of the sensing devices to the brake and/or winch controller. The foregoing devices and other electro-mechanical devices may be limited as to the particular drilling parameter that can be controlled, for example WOB, drilling fluid pressure and drum rotation speed. Further, some of the foregoing devices may require extensive modifications to the drilling rig drawworks equipment to be installed.

It is known in the art to control drilling rig operation using computers. See, for example, F. S. Young, Jr., *Computerized Drilling Control*, Journal of Petroleum Technology, April 1969, Society of Petroleum Engineers, Richardson, Tex. Another computerized drilling control system is disclosed in J. F. Brett et al., Field Experiences With Computer-Controlled Drilling, paper no. 20107, Society of Petroleum Engineers, Richardson, Tex. (1990). Computerized control of drilling operations has some apparent advantages, including greater flexibility over control parameters, simplified installation, faster, more accurate operation of rig equipment. Using computer control, it is also possible to operate the drilling rig equipment to maintain drilling control parameters at optimum values determined by complex control algorithms, rather than simple parameter measurements. See, for example, U.S. Pat. No. 6,192,998 to Pinckard, which is assigned to the assignee of the present invention.

Despite the apparent advantages, computer controlled drilling rig systems have not been widely used. Several reasons for the lack of wide use are disclosed in the Brett et al. reference cited above, and include imprecise control of block position using conventional drawworks control. Because of such imprecision, Brett et al. used an hydraulic lift unit to control the axial motion of the drill string, rather than a conventional drawworks. As described in the Brett et al. reference, hydraulic lift units, while effective, have been difficult to maintain and transport. Other drawworks control devices, such as disclosed in the Frink et al. '530 patent cited above, while effective and adaptable to computer control, require expensive and extensive modification of the drawworks equipment.

Adapting computer control to conventional drawworks motion control devices has also been difficult. A primary source of the difficulty is the fact that conventional drawworks friction brakes are band-type brakes. As is well known in the art, band-type brakes are self-actuating. This aspect of the typical band-type drawworks has made their response difficult to characterize. As a result, it has been believed by those skilled in the art that computer control of conventional band-type brakes is impracticable. See, for example, Boyadjieff et al., *Design Considerations and Field Performance of an Advanced Automatic Driller*, paper no. SPE/IADC 79827, Society of Petroleum Engineers, Richardson, Tex. (2003).

Accordingly, there exists a need for a computerized drilling rig control that is readily adapted to band-brake drawworks controls without extensive equipment modification.

SUMMARY OF INVENTION

One aspect of the invention is an automatic drilling system which includes an electric servo motor operatively coupled to a winch brake control, a servo controller operatively coupled to the servo motor, and a drum position encoder rotationally coupled to a winch drum. The controller is adapted to operate the servo motor in response to measurements of position made by the encoder so that a selected rate of rotation of the drum is maintained.

Other aspects and advantages of the invention will be apparent from the following description and the appended claims.

DETAILED DESCRIPTION

Figure 1:
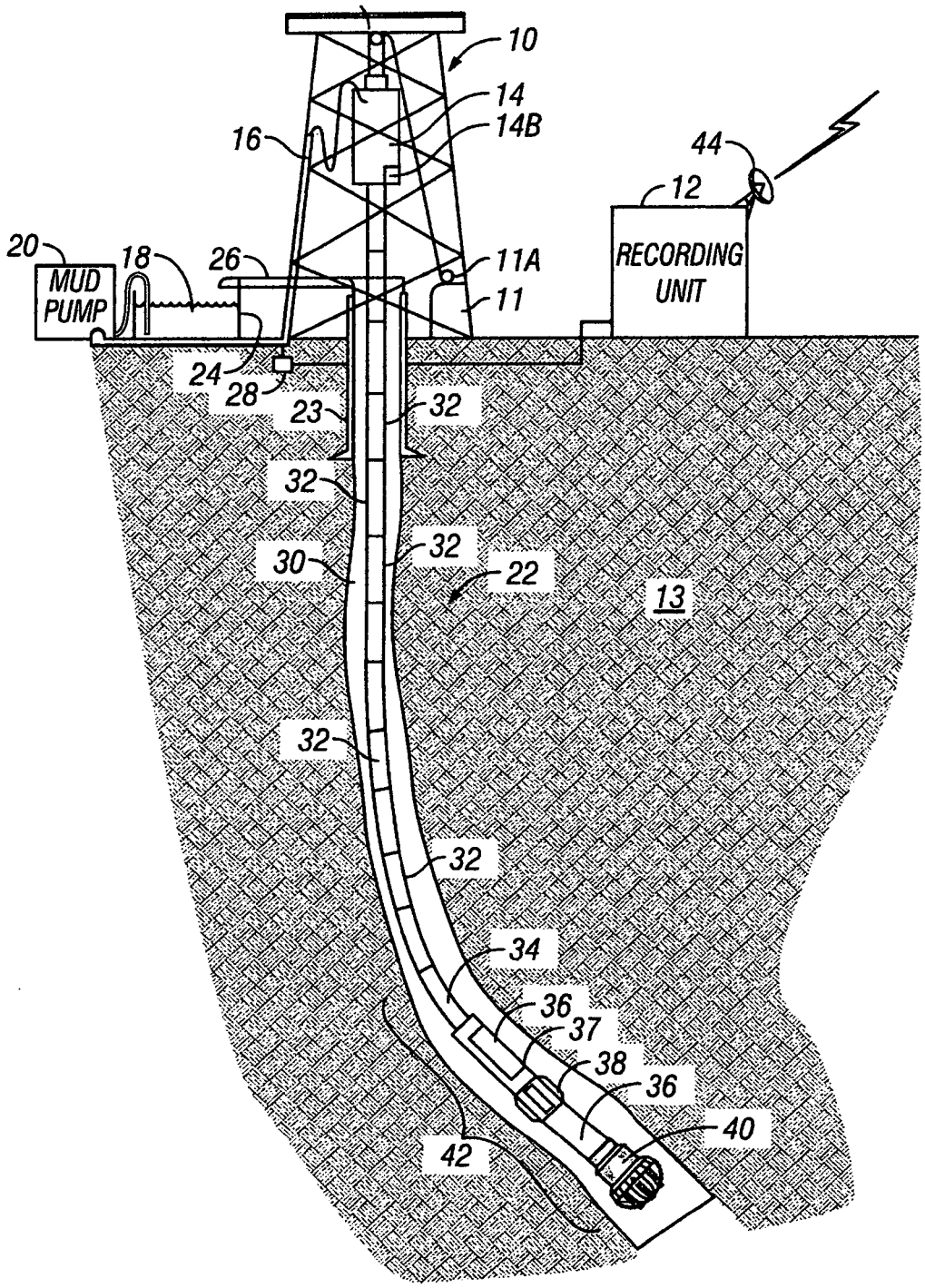
FIG. 1 shows a typical wellbore drilling system which may be used with various embodiments of a method and system according to the invention.

FIG. 1 shows a typical wellbore drilling system which may be used with various embodiments of the invention. A drilling rig 10 includes a drawworks 11 or similar lifting device known in the art to raise, suspend and lower a drill string. The drill string includes a number of threadedly coupled sections of drill pipe, shown generally at 32. A lowermost part of the drill string is known as a bottom hole assembly (BHA) 42, which includes, in the embodiment of FIG. 1, a drill bit 40 to cut through earth formations 13 below the earth's surface. The BHA 42 may include various devices such as heavy weight drill pipe 34, and drill collars 36. The BHA 42 may also include one or more stabilizers 38 that include blades thereon adapted to keep the BHA 42 roughly in the center of the wellbore 22 during drilling. In various embodiments of the invention, one or more of the drill collars 36 may include a measurement while drilling (MWD) sensor and telemetry unit (collectively "MWD system"), shown generally at 37. The sensors included in and the purpose of the MWD system 37 will be further explained below with reference to FIG. 2.

The drawworks 11 is operated during active drilling so as to apply a selected axial force (weight on bit—"WOB") to the drill bit 40. Such axial force, as is known in the art, results from the weight of the drill string, a large portion of which is suspended by the drawworks 11. The unsuspended portion of the weight of the drill string is transferred to the bit 40 as WOB. The bit 40 is rotated by turning the pipe 32 using a rotary table/kelly bushing (not shown in FIG. 1) or preferably a top drive 14 (or power swivel) of any type well known in the art. While the pipe 32 (and consequently the BHA 42 and bit 40) as well is turned, a pump 20 lifts drilling fluid ("mud") 18 from a pit or tank 24 and moves it through a standpipe/hose assembly 16 to the top drive 14 (or kelly/rotary table) so that the mud 18 is forced through the interior of the pipe segments 32 and then the BHA 42. Ultimately, the mud 18 is discharged through nozzles or water courses (not shown) in the bit 40, where it lifts drill cuttings (not shown) to the earth's surface through an annular space between the wall of the wellbore 22 and the exterior of the pipe 32 and the BHA 42. The mud 18 then flows up through a surface casing 23 to a wellhead and/or return line 26. After removing drill cuttings using screening devices (not shown in FIG. 1), the mud 18 is returned to the tank 24. Other embodiments of a drill string may include an hydraulic motor (not shown) therein to turn the drill bit 40 in addition to or in substitution of the rotation provided by the top drive 14 (or kelly/rotary table).

The standpipe system 16 in this embodiment includes a pressure transducer 28 which generates an electrical or other type of signal corresponding to the mud pressure in the standpipe 16. The pressure transducer 28 is operatively connected to systems (not shown separately in FIG. 1) inside a recording unit 12 for decoding, recording and interpreting signals communicated from the MWD system 37. As is known in the art, the MWD system 37 includes a device, which will be explained below with reference to FIG. 2, for modulating the pressure of the mud 18 to communicate data to the earth's surface. In some embodiments the recording unit 12 includes a remote communication device 44 such as a satellite transceiver or radio transceiver, for communicating data received from the MWD system 37 (and other sensors at the earth's surface) to a remote location. Such remote communication devices are well known in the art. The data detection and recording elements shown in FIG. 1, including the pressure transducer 28 and recording unit 12 are only examples of data receiving and recording systems which may be used with the invention, and accordingly, are not intended to limit the scope of the invention. The top drive 14 may also include sensors (shown generally as 14B) for measuring rotational speed of the drill string (RPM), the amount of axial load suspended by the top drive 14 (WOB) and the torque applied to the drill string. The signals from these sensors 14B may be communicated to the recording unit 12 for processing as will be further explained. Another sensor which is operatively coupled to the recording unit 12 is a drum position encoder (not shown in FIG. 1). The encoder and its function will be explained below in more detail with respect to FIG. 3.

Figure 2:
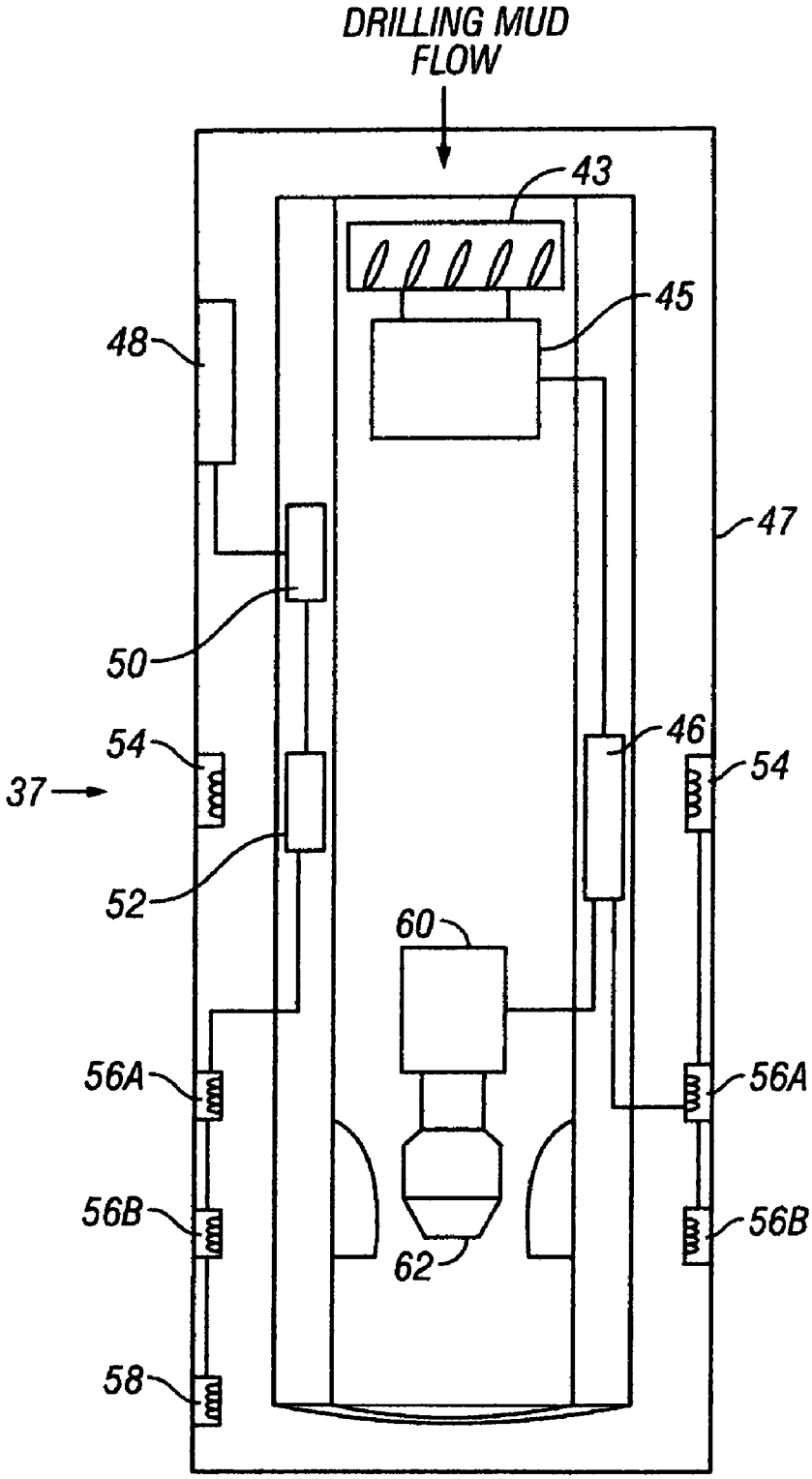
FIG. 2 shows parts of a typical MWD system.

One embodiment of an MWD system, such as shown generally at 37 in FIG. 1, is shown in more detail in FIG. 2. The MWD system 37 is typically 5 disposed inside a non-magnetic housing 47 made from monel or the like and adapted to be coupled within the drill string at its axial ends. The housing 47 is typically configured to behave mechanically in a manner similar to other drill collars (36 in FIG. 1). The housing 47 includes disposed therein a turbine 43 which converts some of the flow of mud (18 in FIG. 1) into rotational energy to drive an alternator 45 or generator to power various electrical circuits and sensors in the MWD system 37. Other types of MWD systems may include batteries as an electrical power source. The signals from the pressure transducer 28 may also be used to provide a drum speed set point control signal to an automatic brake control, as will be explained below with respect to FIG. 5.

Control over the various functions of the MWD system 37 may be performed by a central processor 46. The processor 46 may also include circuits for recording signals generated by the various sensors in the MWD system 37. In this embodiment, the MWD system 37 includes a directional sensor 50, having therein tri-axial magnetometers and accelerometers such that the orientation of the MWD system 37 with respect to magnetic north and with respect to earth's gravity can be determined. The MWD system 37 may also include a gamma-ray detector 48 and separate rotational (angular)/axial accelerometers, magnetometers or strain gauges, shown generally at 58. The MWD system 37 may also include a resistivity sensor system, including an induction signal generator/receiver 52, and transmitter antenna 54 and receiver 56A, 56B antennas. The resistivity sensor can be of any type well known in the art for measuring electrical conductivity or resistivity of the formations (13 in FIG. 1) surrounding the wellbore (22 in FIG. 1). The types of sensors in the MWD system 37 shown in FIG. 2 are not meant to be an exhaustive representation of the types of sensors used in MWD systems in other embodiments of the invention. Accordingly, the particular sensors shown in FIG. 2 are not meant to limit the scope of the invention.

The central processor 46 periodically interrogates each of the sensors in the MWD system 37 and may store the interrogated signals from each sensor in a memory or other storage device associated with the processor 46. Some of the sensor signals may be formatted for transmission to the earth's surface in a mud pressure modulation telemetry scheme. In the embodiment of FIG. 2, the mud pressure is modulated by operating an hydraulic cylinder 60 to extend a pulser valve 62 to create a restriction to the flow of mud through the housing 47. The restriction in mud flow increases the mud pressure, which is detected by the transducer (28 in FIG. 1). Operation of the cylinder 60 is typically controlled by the processor 46 such that the selected data to be communicated to the earth's surface are encoded in a series of pressure pulses detected by the transducer (28 in FIG. 1) at the surface. Many different data encoding schemes using a mud pressure modulator, such as shown in FIG. 2, are well known in the art. Accordingly, the type of telemetry encoding is not intended to limit the scope of the invention. Other mud pressure modulation techniques which may also be used with the invention include so-called "negative pulse" telemetry, wherein a valve is operated to momentarily vent some of the mud from within the MWD system to the annular space between the housing and the wellbore. Such venting momentarily decreases pressure in the standpipe (16 in FIG. 1). Other mud pressure telemetry includes a so-called "mud siren", in which a rotary valve disposed in the MWD housing 47 creates standing pressure waves in the mud, which may be modulated using such techniques as phase shift keying for detection at the earth's surface. Other electromagnetic, hard wired (electrical conductor), or optical fiber or hybrid telemetry systems may be used as alternatives to mud pulse telemetry.

The foregoing description is related to the invention because it includes a number of sensing devices which may alone or in any combination form part of a drum speed set point control signal used to control a rate of release of the drill string into the wellbore. The drum speed set point control signal can be used by the computer in the recording unit (12 in FIG. 1) or can be used by another computer, for example a controller that will be explained below with respect to FIGS. 3–5, to determine a rate at which to release the drill string. In an embodiment of the invention described below with respect to FIG. 3, operation of a band-type brake, forming part of the drawworks (11 in FIG. 1), is precisely controlled so as to maintain the predetermined rate of release of the drill string. As described in the Background section herein, the drum speed set point control signal may also be generated by a control algorithm which accepts as input measurements from various sensing devices (such as described above with respect to FIG. 1 and FIG. 2) and which generates as an output a predetermined rate at which the drill string is to be released into the wellbore. See, for example, the previously described U.S. Pat. No. 6,192,998 to Pinckard, which is assigned to the assignee of the present invention and incorporated herein by reference for all purposes.

Figure 3:
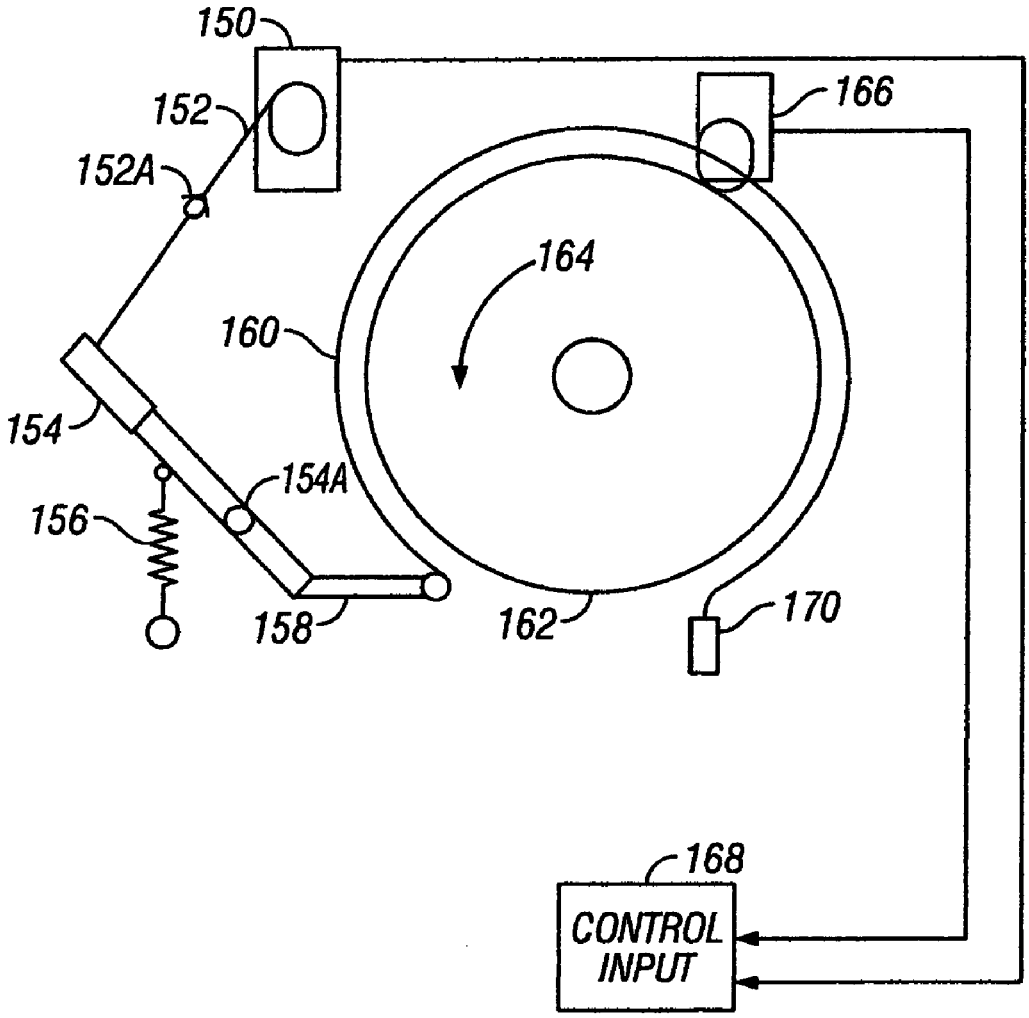
FIG. 3 shows a drawworks brake control according to one embodiment of the invention.

Referring now to FIG. 3, one embodiment of a brake control system according to the invention will now be explained. A band-type brake system forms part of the drawworks (11 in FIG. 1) and includes a brake band 160 usually formed from steel or similar material, and having a suitable friction lining (not shown) on its interior surface for selective engagement with a corresponding braking flange (not shown) on a winch drum 162. The drum 162 rotates in the direction shown by arrow 164 as the drill string is released into the wellbore. The brake band 160 is anchored at one end by anchor pin 170, and is movable at its other end through a link 158 coupled to one end of a brake control handle 154. The brake control handle 154 is arranged on a pivot 154A or the like such that when the brake control handle 154 is lifted, the band 160 is released from engagement with the drum 162. Releasing the brake band 160 enables the drum to rotate as shown at 164, such that gravity can draw the drill string down, and through a drill line (not shown) ultimately wound around the drum, causes the axial motion of the drill string to be converted to drum 162 rotation. Applying the brake band 160 by releasing the handle 154 slows or stops rotation of the drum 162, and thus slows or stops axial movement of the drill string into the wellbore. Typically, the handle 154 will be drawn downward by a safety spring 156 so that in the event the driller loses control of the handle 154 the drum 162 will stop rotating. The spring 156 is a safety feature, but is not an essential part of a system according to the invention.

In the present embodiment, the automatic control system includes an electric servo motor 150 coupled to the brake handle 154 by a cable 152. The cable 152 may include a quick release 152A or the like of types well known in the art as a safety feature. A rotary encoder 166 is rotationally coupled to the drum 162. The encoder 166 generates a signal related to the rotational position of the drum 162. Both the servo motor 150 and the encoder 166 are operatively coupled to a controller 168, which may reside in the recording unit (12 in FIG. 1) or elsewhere on the drilling rig. The controller 168 may be a purpose built digital processor, or may be part of a general purpose, programmable computer.

The servo motor 150 includes an internal sensor (not shown separately in FIG. 3), which may be a rotary encoder similar to the encoder 166, or other position sensing device, which communicates the rotational position of the servo motor 150 to the controller 168. The encoder 166 in the present embodiment can be a sine/cosine output device coupled to an interpolator (not shown separately) in the controller 168. The encoder 166 in the present embodiment, in cooperation with the interpolator, generates the equivalent of approximately four million output pulses for each complete rotation of the drum 162, thus providing extremely precise indication of the rotational position of the drum 162 at any instant in time. A suitable encoder is the ENDAT MULTITURN EQN-425, made by Dr. Johannes Heidenhain GmbH, Traunreut, Germany. It is within the scope of the invention for other encoder resolution values to be used.

The controller 168 determines, at a selected calculation rate, the rotational speed of the drum 162 by measuring the rate at which pulses from the encoder 166 are detected. In the present embodiment, controller 168 is programmed to operate a proportional integral derivative (PID) control loop, such that the servo motor 150 is operated to move the brake handle 154 if the calculated drum 162 rotation speed is different than a value determined by a control input. The control input will be further explained below with respect to FIGS. 4 and 5. The embodiment shown in FIG. 3 is only one example of coupling a servo motor to a band-type brake. Those of ordinary skill in the art will appreciate that other devices may be used to couple the rotary motion of the servo motor 150 to operate the brake band 160. Advantageously, a system made as shown in FIG. 3 can be easily and inexpensively adapted to many existing drilling rigs.

It has been determined that by using an encoder having sufficient rotational resolution, and by using a servo motor having sufficient positional resolution and operating speed, it is possible to control the rotation rate of the drum 162 without the need to precisely characterize the frictional response of the brake (including band 162) with respect to the position of the handle 154. This is a substantial improvement over prior art brake control systems, which require some form of characterization of the braking response. See, for example, Boyadjieff et al., *Design Considerations and Field Performance of an Advanced Automatic Driller,* paper no. SPE/IADC 79827, Society of Petroleum Engineers, Richardson, Tex. (2003) cited in the Background section herein. In fact, it was believed that characterization of band-type brakes was so difficult that it was impracticable to adapt computer control to band-type brakes for an automatic driller. See the Boyadjieff et al. reference cited above, which discloses the use of proportional (caliper) type brakes because of the difficulty in characterizing band brake response.

Figure 4:
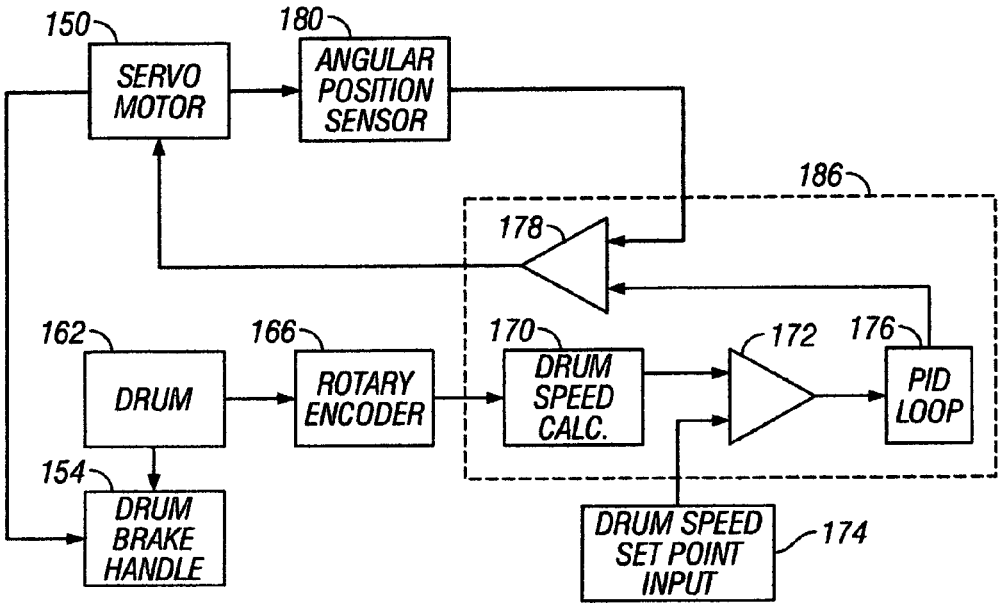
FIGS. 4 and 5 show example control processes usable with various embodiments of a system according to the invention.

The control input signal shown in FIG. 3 and its relationship to controlling brake handle operation may be better understood by a logic flow diagram shown in FIG. 4. A subprocess, shown at L1, operates on the controller 168 (or other computer) to make a determination of the drum rotation speed from the signal conducted from the encoder 166. The drum speed forms one input to a comparator 172. The previously described drum speed set point control signal 174 forms the other input to comparator 172. The output of comparator 172 is conducted to the PID loop 176, which may run on the controller 168, or a separate processor. The output of the PID loop 176 is an expected rotational position of the servo motor 150. Because the servo motor 150 is directly coupled to the brake handle (154 in FIG. 3), the servo motor 150 rotational position substantially directly corresponds to the position of the brake handle 154. The expected position is compared, in a comparator 178, to the actual position of the servo motor 150 determined from the position sensor 180 in the servo motor 150. The output of comparator 178 is used to drive the servo motor 150 until the difference is substantially zero. The control loop described above with respect to FIG. 4 enables the brake controller of the invention to maintain a drum rotation rate at whatever value is determined with respect to the drum speed set point control signal input to the controller 168. As will be explained below with respect to FIG. 5, the control signal may be a fixed value corresponding to a selected rate of penetration, or the control signal may be automatically determined by calculation performed on one or more sensor measurements.

Figure 5:
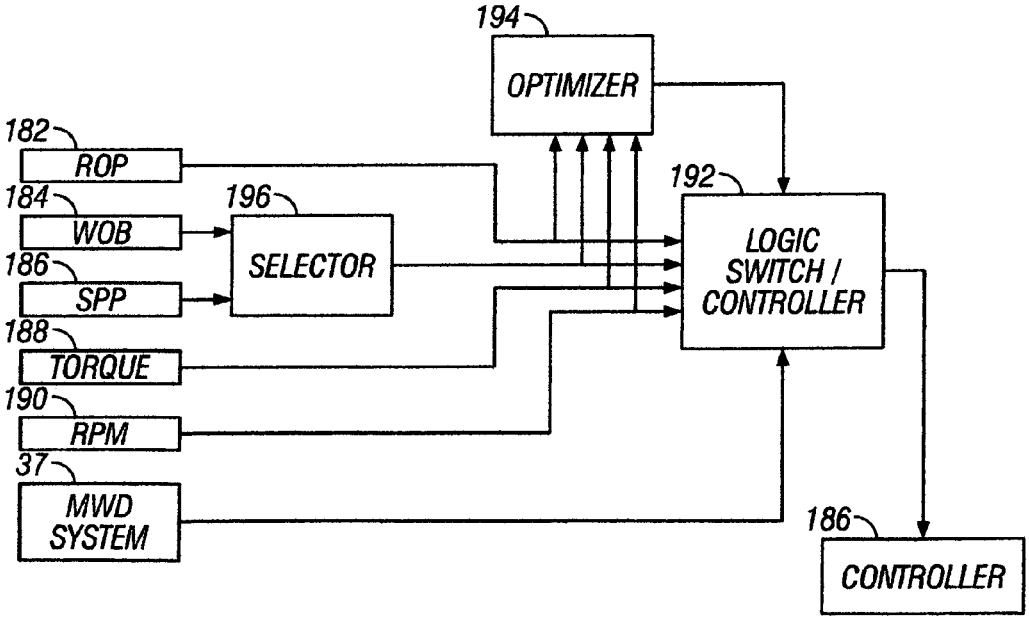

FIG. 5 shows different signal inputs which may be used in various embodiments of a system according to the invention. Inputs which may originate from sensors disposed at the earth's surface include ROP 182 itself (determined from drum rotation rate as explained above with respect to in FIG. 4); WOB from a sensor on the drill line or hook (14B in FIG. 1); drilling fluid standpipe pressure (SPP) 186 (from transducer 28 in FIG. 1); torque (from sensor 14B in FIG. 1); and RPM (from sensor 14B in FIG. 1). Measurements which may originate from the MWD system (37 in FIG. 1) may include wellbore azimuth, wellbore inclination, formation resistivity, drilling fluid pressure in a wellbore annulus and amounts of axial, lateral and/or rotational acceleration measured by the various sensors in the MWD system and communicated through modulation of the drilling fluid pressure, as previously explained. A logic switch/controller 192, which may operate on the controller (168 in FIG. 4) or any other computer or hardware implementation, may select any one or more of the sensor signals as an input to determine a set point for rotation rate of the drum (and consequent rate of release of the drill string).

In one embodiment, measurements of ROP, WOB, standpipe pressure, RPM and/or torque are conducted to an optimizer 194. The optimizer 194 may operate a rate of penetration optimizing algorithm, such as one disclosed in U.S. Pat. No. 6,192,998 to Pinckard, which is assigned to the assignee of the present invention. An optimized value of ROP determined by the optimizer algorithm may be conducted to the logic switch/controller 176, then to the controller 168 for controlling drum rotation rate to match the optimized ROP.

In one embodiment, ROP may be set to a predetermined value. In this embodiment, the brake controller is operated to release the drill string so as to maintain the ROP at the predetermined value.

In another embodiment, WOB may be set to a predetermined value. In this embodiment, the brake controller is operated to release the drill string so as to maintain the WOB at the predetermined value.

In another embodiment standpipe (drilling fluid internal) pressure may be set to a predetermined value. The brake controller in this embodiment is operated to release the drill string so as to maintain the predetermined value.

In other embodiments, torque or RPM may be set to a predetermined value. The brake controller is operated to release the drill string to maintain the predetermined value. In one embodiment, a selector 196 determines when either standpipe pressure or WOB has reached a predetermined limit value. If the limit value is reached, the other value of WOB or standpipe pressure becomes the control variable and is conducted as the control signal to the controller (168 in FIG. 4) through the logic switch 192. Brake operation then is performed as in the other embodiments to release the drill string so as to maintain the control parameter substantially at the preselected value.

In another embodiment, the azimuth and inclination measurements from the MWD system 37 may be used as the control signal input to the controller (168 in FIG. 3). In this embodiment, the brake controller is operated to release the drill string so as to maintain either or both the azimuth and inclination of the wellbore at a substantially constant value.

Embodiments of a system according to the invention may provide enhanced drilling operating control, improved drilling performance, and the ability to retrofit band-brake drawworks systems inexpensively.

While the invention has been described with respect to a limited number of embodiments, those of ordinary skill in the art, having the benefit of the foregoing description will be able to devise other embodiments which to not depart from the scope of the invention. Accordingly, the invention should be limited in scope only by the attached claims.

What is claimed is:

1. An automatic drilling system, comprising:

an electric servo motor arranged to operate a winch brake control;

a servo controller operatively coupled to the servo motor; and a drum position encoder rotationally coupled to a winch drum and operatively coupled to the servo controller, the servo controller adapted to operate the servo motor in response to measurements of position made by the encoder so that a selected rate of rotation of the winch drum is maintained.

2. The system of claim 1 wherein the encoder comprises a sine/cosine output transducer.

3. The system of claim 1 wherein a winch brake operated by the winch brake control comprises a band brake.

4. The system of claim 1 wherein the selected rate of rotation is related to a selected rate of axial motion of a drill string.

5. The system of claim 1 further comprising a drilling fluid pressure sensor operatively coupled to the servo controller, the servo controller adapted to control the rate of rotation so as to substantially maintain a predetermined drilling fluid pressure.

6. The system of claim 1 further comprising a bit weight sensor operatively coupled to the servo controller, the controller adapted to control the rate of rotation so as to substantially maintain a predetermined axial force on a drill bit.

7. The system of claim 1 further comprising a logic switch selectable to conduct one or more of a plurality of control signals to the servo controller, the control signals setting the selected rate of rotation.

8. The system of claim 7 wherein the control signal comprises at least one of drilling fluid pressure, axial force on a drill bit, rate of penetration of a drill bit, wellbore inclination and wellbore azimuth.

9. The system of claim 1 further comprising a rate optimizer operatively coupled at an input thereof to at least one drilling operating parameter sensor, an output of the optimizer operatively coupled to the servo controller, the optimizer adapted to calculate a rate of axial motion of the drill string in response to measurements of the at least one drilling operating parameter.

10. The system of claim 9 wherein the at least one drilling operating parameter sensor comprises a weight on bit sensor.

11. The system of claim 9 wherein the at least one drilling operating parameter sensor comprises a drill string torque sensor.

12. The system of claim 9 wherein the at least one drilling operating parameter sensor comprises a drill string rotation rate sensor.

13. The system of claim 9 wherein the at least one drilling operating parameter sensor comprises a sensor measuring a parameter related to axial position of the drill string.

14. The system of claim 13 wherein the axial position sensor comprises the drum position encoder.

15. The system of claim 9 wherein the at least one drilling operating parameter sensor comprises a sensor measuring a parameter related to a wellbore trajectory.

16. The system of claim 1 wherein a resolution of the encoder is about four million output increments per revolution of the drum.

17. A method for controlling a rate of release of a drill string, comprising:

measuring a parameter related to rotational position of a drawworks drum;

measuring a parameter related to operating position of a drawworks brake;

determining a rate of rotation of the drum from the rotational position related parameter measurement; and adjusting the operating position of the brake so as to substantially maintain the rate of rotation at a selected value using the measured operating position parameter and the measured rotational position parameter.

18. An automatic drilling system, which comprises:

an electric servo motor coupled to a drawworks winch drum brake actuator so as to operate the actuator;

means for determining drawworks winch drum speed of rotation; and means for controlling said servo motor based upon a difference between said drawworks winch drum speed of rotation and a speed of rotation set point.

19. The automatic drilling system as claimed in claim 18, wherein said means for determining includes: a rotary encoder coupled to said drawworks winch drum; and, means coupled to said rotary encoder for calculating said drawworks winch drum speed of rotation.

20. The automatic drilling system as claimed in claim 18, wherein said means for controlling said servo motor includes: a comparator for comparing said drawworks winch drum speed of rotation with said speed of rotation set point.

21. The automatic drilling system as claimed in claim 18, wherein said means for controlling said servo motor includes; means for setting an angular position set point for said servo motor based upon said difference between said drawworks winch drum speed of rotation and said speed of rotation set point.

22. The automatic drilling system as claimed in claim 21, including: means for determining the angular position of said servo motor; and, means for comparing said angular position of said servo motor with said angular position set point.

* * * * *